US008610657B2

(12) United States Patent
Chung

(10) Patent No.: US 8,610,657 B2
(45) Date of Patent: Dec. 17, 2013

(54) SOURCE DRIVER, COMMON VOLTAGE DRIVER, AND METHOD OF DRIVING DISPLAY DEVICE USING TIME DIVISION DRIVING METHOD

(75) Inventor: Kyu-Young Chung, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 1498 days.

(21) Appl. No.: 11/743,182

(22) Filed: May 2, 2007

(65) Prior Publication Data

US 2008/0068325 A1 Mar. 20, 2008

(30) Foreign Application Priority Data

Sep. 20, 2006 (KR) ..... 10-2006-0091354

(51) Int. Cl.
*G09G 3/36* (2006.01)

(52) U.S. Cl.
USPC ..... 345/100; 345/87; 345/99; 345/98

(58) Field of Classification Search
USPC ..... 345/100, 204, 87
See application file for complete search history.

(56) References Cited

U.S. PATENT DOCUMENTS

| | | | | |
|---|---|---|---|---|
| 5,489,910 | A * | 2/1996 | Kuwata et al. | 345/212 |
| 5,517,207 | A * | 5/1996 | Kawada et al. | 345/78 |
| 5,617,111 | A * | 4/1997 | Saitoh | 345/100 |
| 5,729,246 | A * | 3/1998 | Masuko | 345/98 |
| 6,069,605 | A * | 5/2000 | Ozawa | 345/98 |
| 6,304,241 | B1 * | 10/2001 | Udo et al. | 345/96 |
| 6,307,681 | B1 * | 10/2001 | Aoki et al. | 359/645 |
| 6,614,416 | B1 * | 9/2003 | Yamamoto et al. | 345/94 |
| 6,816,144 | B2 * | 11/2004 | Tsuchi | 345/100 |
| 7,068,292 | B2 * | 6/2006 | Morita | 345/690 |
| 7,151,516 | B2 * | 12/2006 | Takeda et al. | 345/87 |
| 7,298,352 | B2 * | 11/2007 | Kang et al. | 345/87 |
| 7,420,552 | B2 * | 9/2008 | Kushima et al. | 345/211 |
| 7,508,368 | B2 * | 3/2009 | Miyazaki | 345/98 |
| 2004/0012553 | A1 * | 1/2004 | Lee et al. | 345/87 |
| 2005/0088394 | A1 * | 4/2005 | Chung | 345/96 |
| 2007/0195054 | A1 * | 8/2007 | Kwon | 345/100 |

FOREIGN PATENT DOCUMENTS

| | | |
|---|---|---|
| JP | 11-030975 | 2/1999 |
| JP | 2004-069848 | 3/2004 |
| KR | 1998-071138 | 10/1998 |
| KR | 10-2002-0059222 | 7/2002 |
| KR | 1020040093877 A | 11/2004 |
| KR | 10-2005-0040790 | 5/2005 |
| KR | 1020050070778 A | 7/2005 |

OTHER PUBLICATIONS

English Abstract for Publication No. 10-2002-0059222.
English Abstract for Publication No. 10-2005-0040790.
Korean Office Action Dated Aug. 10, 2012.

* cited by examiner

*Primary Examiner* — Grant Sitta
(74) *Attorney, Agent, or Firm* — F. Chau & Associates, LLC

(57) ABSTRACT

A source driver and a common voltage driver for a display device using a time division driving method, in which the source driver outputs an analog voltage corresponding to digital image data to a corresponding source line out of a plurality of source lines, after precharging the corresponding source line with a predetermined voltage. The common voltage driver discretely and sequentially increases or decreases the common voltage. By using the source driver and the common voltage driver, the power consumed upon driving of the display device can be reduced.

11 Claims, 10 Drawing Sheets

SOURCE DRIVER, COMMON VOLTAGE DRIVER, AND METHOD OF DRIVING DISPLAY DEVICE USING TIME DIVISION DRIVING METHOD

CROSS-REFERENCE TO RELATED PATENT APPLICATION

This application claims priority under 35 U.S.C. §119 from Korean Patent Application No. 10-2006-0091354, filed on Sep. 20, 2006, the disclosure of which is hereby incorporated by reference herein as if set forth in its entirety.

BACKGROUND OF THE INVENTION

1. Technical Field

The present disclosure relates to a technique of driving a display device and, more particularly, to a source driver, a common voltage driver, and a method of driving a display device using a time division driving method.

2. Discussion of Related Art

Thin film transistor liquid crystal displays (hereinafter, referred to as TFT-LCDs) are representative flat panel display devices, and are widely used in TVs, monitors, cellular phones, and the like.

FIG. 1 is a block diagram of a conventional display device 1. Referring to FIG. 1, the conventional display device 1 includes a display panel 10, a source driver 100, and a common voltage driver 200. The display panel 10 includes a plurality of source lines S1 through Sm and a common voltage line, and displays an image signal in response to a common voltage VCOM applied to the common voltage line and an analog voltage corresponding to a digital image signal supplied to the source lines S1 through Sm.

FIG. 2 is a structure diagram of the source driver 100 that is driven using a time division driving method. Referring to FIG. 2, the source driver 100 includes a controller 110, a data selection circuit 120, a polarity control circuit 130, a latch circuit 140, a digital-to-analog converter (DAC) 150, an output buffer 160, and a plurality of switches SW1 through SWm.

The controller 110 generates a plurality of channel selection signals CSEL1 through CSELm, a polarity control signal PCS, and a latching signal LS in response to a clock signal CLK. The data selection circuit 120 receives a plurality of digital image data VD1 through VDm, selects one of the digital image data VD1 through VDm in response to the channel selection signals CSEL1 through CSELm from the controller 110, and outputs the selected image data. Each of the digital image data VD1 through VDm may include n bits (where n and m are natural numbers).

The polarity control circuit 130 selectively inverts output data of the data selection circuit 120 in response to the polarity control signal PCS and outputs the result of the selective inversion. The reason the inversion of the output data of the data selection circuit 120 is performed, as is generally known, is to prevent degradation of the liquid crystal. The latch circuit 140 receives and stores output data of the polarity control circuit 130, and outputs the output data of the polarity control circuit 130 to the DAC 150 in response to the latching signal LS.

The DAC 150 receives a plurality of analog voltages VG[$2^n$:1] that are generated on the basis of the number of bits of the digital image data, and outputs an analog voltage corresponding to output data of the latch, circuit 140 from among the analog voltages VG[$2^n$:1].

For example, when the digital image data includes n bits, the number of analog voltages VG[$2^n$:1] is $2^n$ and the DAC 150 outputs an analog voltage corresponding to the output data of the latch circuit 140 from among the $2^n$ analog voltages VG[$2^n$:1]. The output buffer 160 receives a first power supply voltage AVDD, and buffers and outputs the analog voltage outputted from the DAC 150. The output buffer 160 improves the current driving ability of the source driver 100.

The switches SW1 through SWm output the analog voltage buffered by the output buffer 160 to one of the source lines S1 through Sm in response to the channel selection signals CSEL1 through CSELm.

FIG. 3 is a structure diagram of the common voltage driver 200. Referring to FIG. 3, the common voltage driver 200 includes an output terminal VCOM, a first amplifier 210, a second amplifier 220, a first switch SW1, and a second switch SW2.

The first amplifier 210 receives the first power supply voltage AVDD, and amplifies a first input voltage Vin1 to output a first voltage VCOMH. The second amplifier 220 receives a second power supply voltage VCL, and amplifies a second input voltage Vin2 to output a second voltage VCOML. The first switch SW1 is connected between an output terminal of the first amplifier 210 and the output terminal VCOM, and is switched on to supply the first voltage VCOMH to the output terminal VCOM in response to a first voltage control signal VCS1.

The second switch SW2 is connected between an output terminal of the second amplifier 220 and the output terminal VCOM, and is switched on to supply the second voltage VCOML, to the output terminal. VCOM in response to a second voltage control signal VCS2.

FIG. 4 is a timing diagram representing time-division driving operations of the source driver 100 and the common voltage driver 200 shown in FIG. 2 and FIG. 3, respectively. Referring to FIGS. 2 through 4, the channel selection signals CSEL1 through CSELm, which have predetermined activation sections, for example, high levels are applied to the data selection circuit 120 and the switches SW1 through SWm.

The data selection circuit 120 selects and outputs one of the digital image data VD1 through VDm in response to the channel selection signals CSEL1 through CSELm, and the switches SW1 through SWm output the analog voltage buttered by the output buffer 160 to a corresponding source line out of the source lines S1 through Sm in response to the channel selection signals CSEL1 through CSELm.

The polarity control signal PCS is applied to the polarity control circuit 130. The polarity control circuit 130 inverts a polarity of the output data of the data selection circuit 120 every horizontal scan period 1H.

The latching signal LS has as many activation sections as the number of channel selection signals CSEL1 through CSELm and is activated at the points in time when the channel selection signals are activated. The latching circuit 140 outputs the stored digital image data at the points in time when, the latching signal LS is activated.

The first voltage control signal VCS1 is in phase with the polarity control signal PCS, and the second voltage control signal VCS2 is in opposite phase with the first voltage control signal VCS1. When the first voltage control signal VCS1 is activated, the voltage level of the output terminal VCOM, of the common voltage driver 200 becomes the first voltage VCOMH. When the second voltage control signal VCS2 is activated, the voltage level of the output terminal VCOM becomes the second voltage VCOML.

FIG. 5 is a block diagram of a boosting circuit of a general display device, and FIG. 6 illustrates a load model of a general display panel.

Referring to FIG. 5, the boosting circuit receives a reference voltage VDD and outputs the first power supply voltage AVDD, which is obtained by amplifying the reference voltage VDD a times, and the second power supply voltage VCL, which is obtained by amplifying the reference voltage VDD-β times. Here, α is an integer equal to or greater than 2, and β is an integer equal to or greater than 1. Referring to FIG. 6, Cs denotes an equivalent capacitor viewed from a source line, and Ccom denotes an equivalent capacitor viewed from a ground line to which the output terminal of the common voltage driver 200 may be connected.

A maximum average current consumed for one horizontal scan period 1H(1T) upon the aforementioned driving operations of the source driver 100 and the common voltage driver 200 using a general time division driving method will now be described. Referring to FIG. 4, when a polarity of the common voltage VCOM is opposite to that of an analog voltage supplied to a source line, a maximum average current is consumed in the display panel 10.

An average current Iavdd for the first power supply voltage AVDD supplied to the output buffer 160 of the source driver 100 is calculated using Equation 1;

$$Iavdd = \frac{Cs(VCOMH - VCOML + VH - VL)}{2T} \quad (1)$$

An average current Ivcomh for the first power supply voltage AVDD supplied to the first amplifier 210 of the common voltage driver 200 is calculated using Equation 2:

$$Ivcomh = \frac{Cs(VCOMH - VCOML + VH - VL) + Ccom(VCOMH - VCOML)}{2T} \quad (2)$$

An average current Ivcom1 for the second power supply voltage VCL supplied to the second amplifier 220 of the common voltage driver 200 is calculated using Equation 3:

$$Ivcoml = \frac{Cs(VCOMH - VCOML + VH - VL) + Ccom(VCOMH - VCOML)}{2T} \quad (3)$$

A total average current Itot for the reference voltage VDD of the source driver 100 and the common voltage driver 200, being an average of the average currents of Equations 1 and 3, is calculated using Equation 4:

$$Itot = \frac{(2_{\alpha+\beta})Cs(VCOMH - VCOML + VH - VL) + (\alpha + \beta)Ccom(VCOMH - VCOML)}{2T} \quad (4)$$

As shown in Equations 1 through 4, when the source driver 100 and the common voltage driver 200 are driven using a generally known time division driving method, a large amount of current is consumed in the display device 1.

SUMMARY OF THE INVENTION

Exemplary embodiments of the present invention provide a source driver outputting an analog voltage corresponding to digital image data after precharging a corresponding source line out of a plurality of source lines with a predetermined voltage, a common voltage driver discretely and sequentially increasing or decreasing a common voltage, and a display device including the source driver and/or the common voltage driver, in order to reduce power consumption for driving the display device using a time division driving method.

A source driver according to an exemplary embodiment of the present invention comprises a first buffer buffering a predetermined voltage, a plurality of first switches, each connected between an output terminal of the first buffer and a corresponding one of a plurality of source lines, a second buffer buffering an analog voltage corresponding to digital image data, and a plurality of second switches, each connected between an output terminal of the second buffer and a corresponding one of the source lines.

A source driver according to an exemplary embodiment of the present invention comprises a first buffer buffering a predetermined voltage, a first switching block supplying an output voltage of the first buffer to one of a plurality of source lines in response to a plurality of control signals, a second buffer buffering an analog voltage corresponding to digital image data, a second switching block supplying an output voltage of the second buffer to one of the source lines in response to a plurality of channel selection signals, and a controller generating the control signals and the channel selection signals so that the output voltage of the second buffer is supplied to the corresponding source line out of the source lines after the output voltage of the first buffer is supplied to the corresponding source line out of the plurality of source lines.

A common voltage driver according to an exemplary embodiment of the present invention comprises an output terminal outputting a common voltage, a first amplifier amplifying a first input voltage to output a first voltage, a first switch connected between the output terminal of the common voltage driver and an output terminal of the first amplifier, a second switch connected between a first line for receiving a second voltage and the output terminal of the common voltage driver, a third switch connected between a second line for receiving a third voltage and the output terminal of the common voltage driver, a second amplifier amplifying a second input voltage to output a fourth voltage, and a fourth switch connected between the output terminal of the common voltage driver and an output terminal of the second amplifier.

A method of driving a display device according to an exemplary embodiment of the present invention comprises the operations of buffering a predetermined voltage in a corresponding source line out of a plurality of source lines and buffering an analog voltage corresponding to digital image data to the corresponding source line out of the plurality of source lines.

BRIEF DESCRIPTION OF THE DRAWINGS

Exemplary embodiments of the present invention will be understood in more detail from the following descriptions taken in conjunction with the attached drawings, in which.

DETAILED DESCRIPTION OF EXEMPLARY EMBODIMENTS

Figure 1:
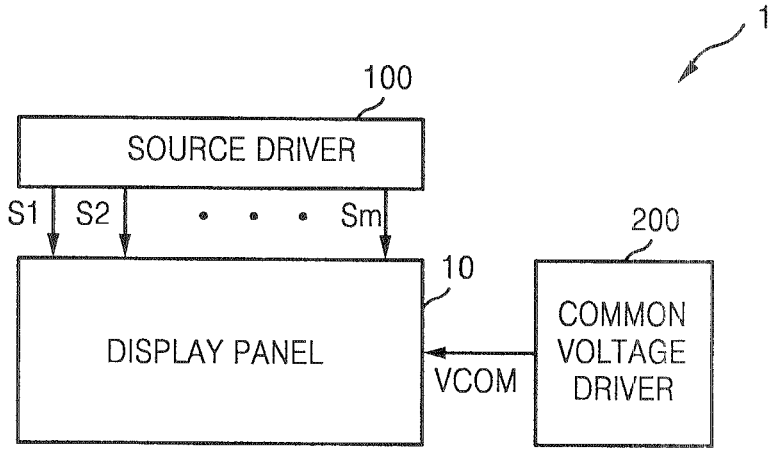
FIG. 1 (RELATED ART)
FIG. 1 is a block diagram of a conventional display device.
Figure 2:
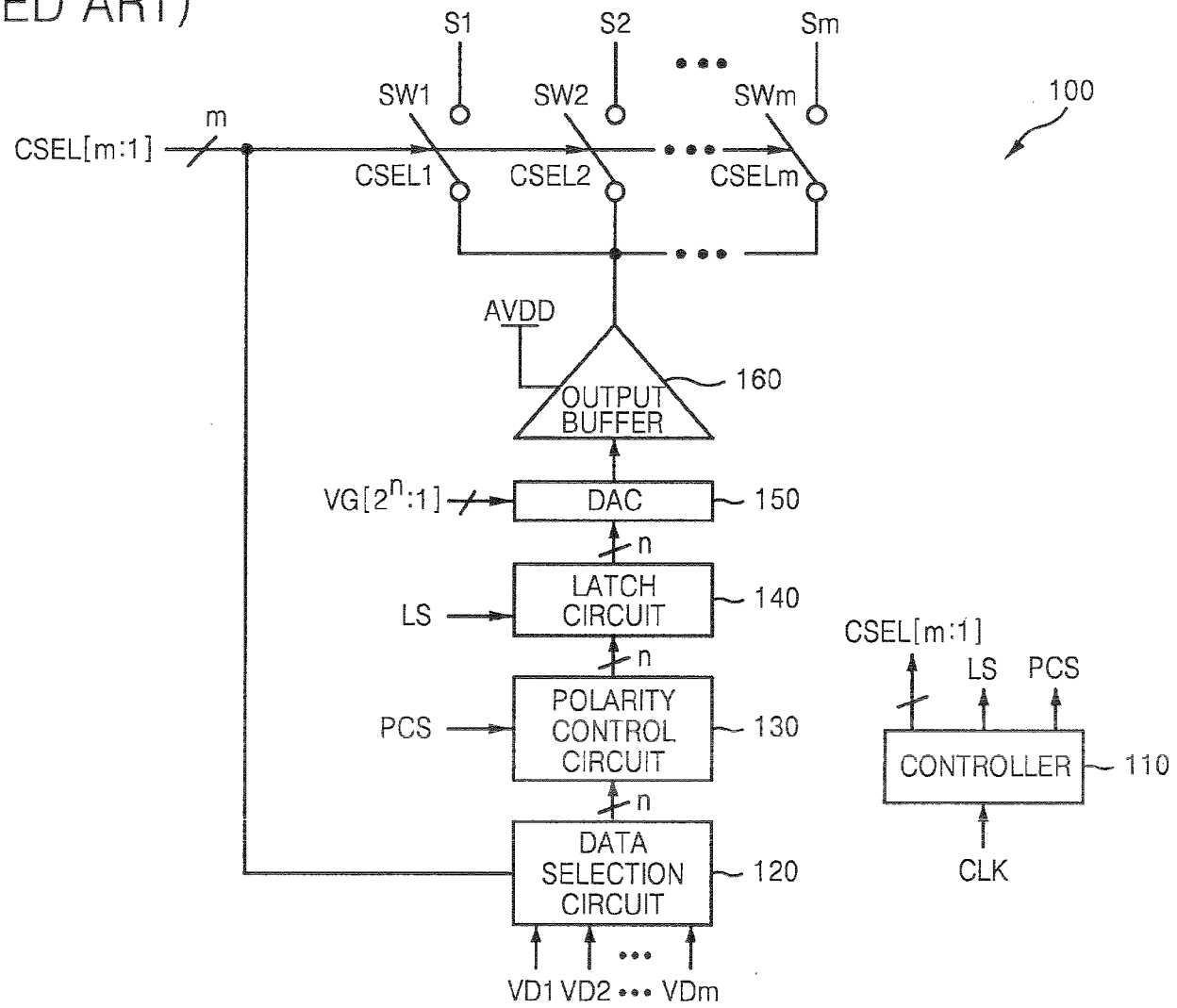
FIG. 2 (RELATED ART)
FIG. 2 is a structure diagram of a source driver that is driven using a known general time division driving method.
Figure 3:
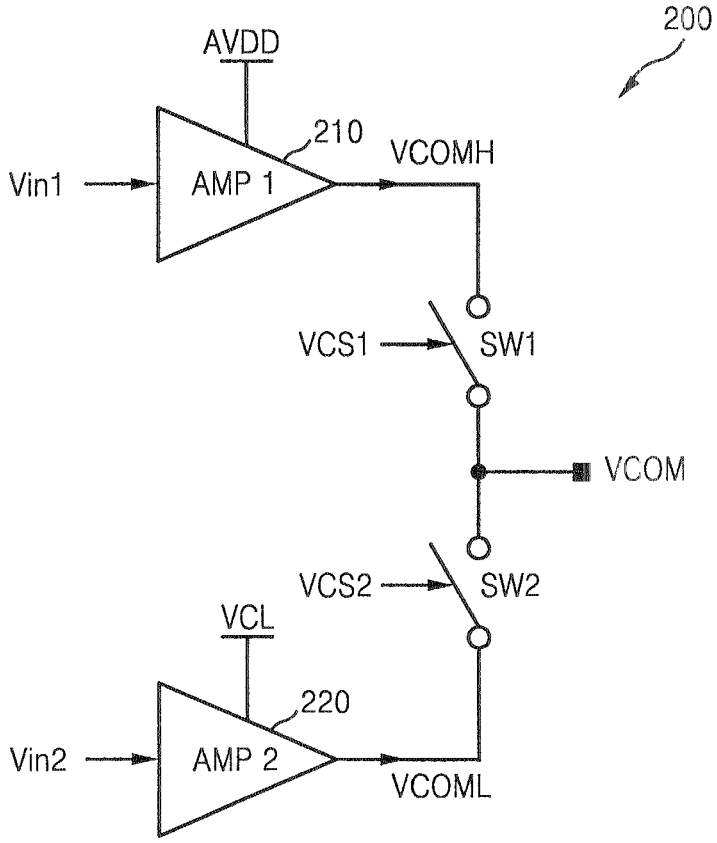
FIG. 3 (RELATED ART)
FIG. 3 is a structure diagram of a conventional common voltage driver.
Figure 4:
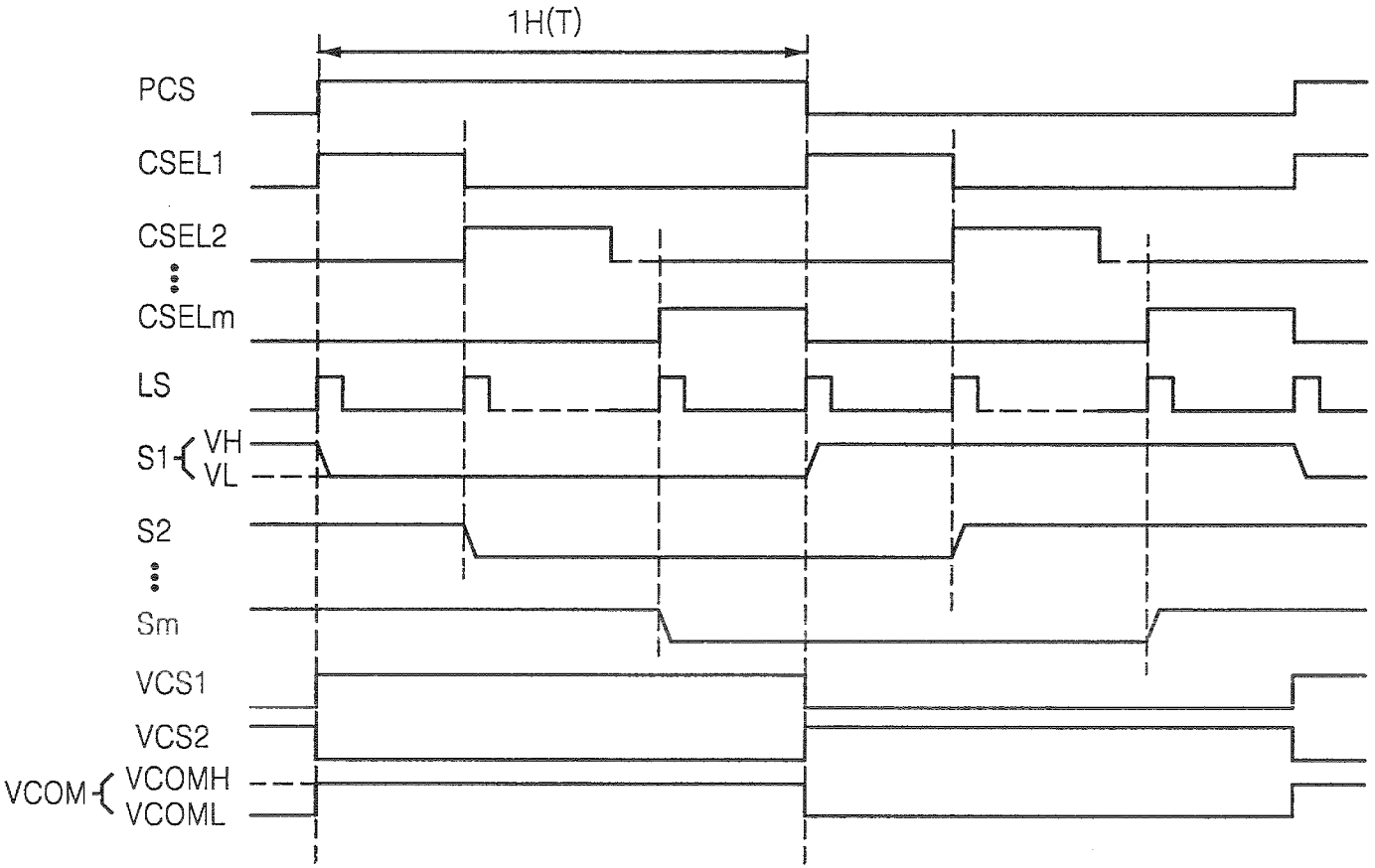
FIG. 4 (RELATED ART)
FIG. 4 is a timing diagram representing driving of the source driver and the common voltage driver shown in FIG. 2 and FIG. 3, respectively.
Figure 5:
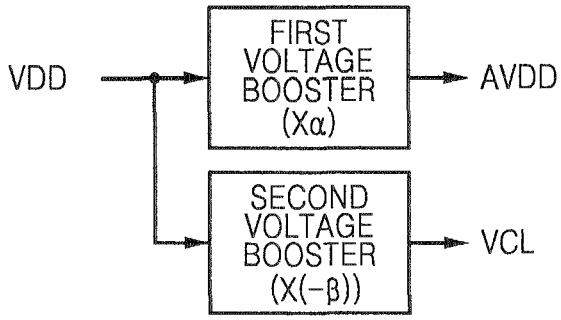
FIG. 5 (RELATED ART)
FIG. 5 is a block diagram for a boosting circuit of a general display device.
Figure 6:
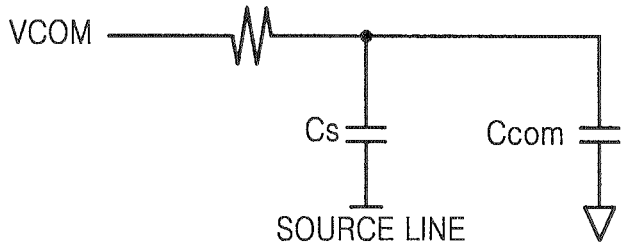
FIG. 6 (RELATED ART)
FIG. 6 is a load model of a general display panel.
Figure 7:
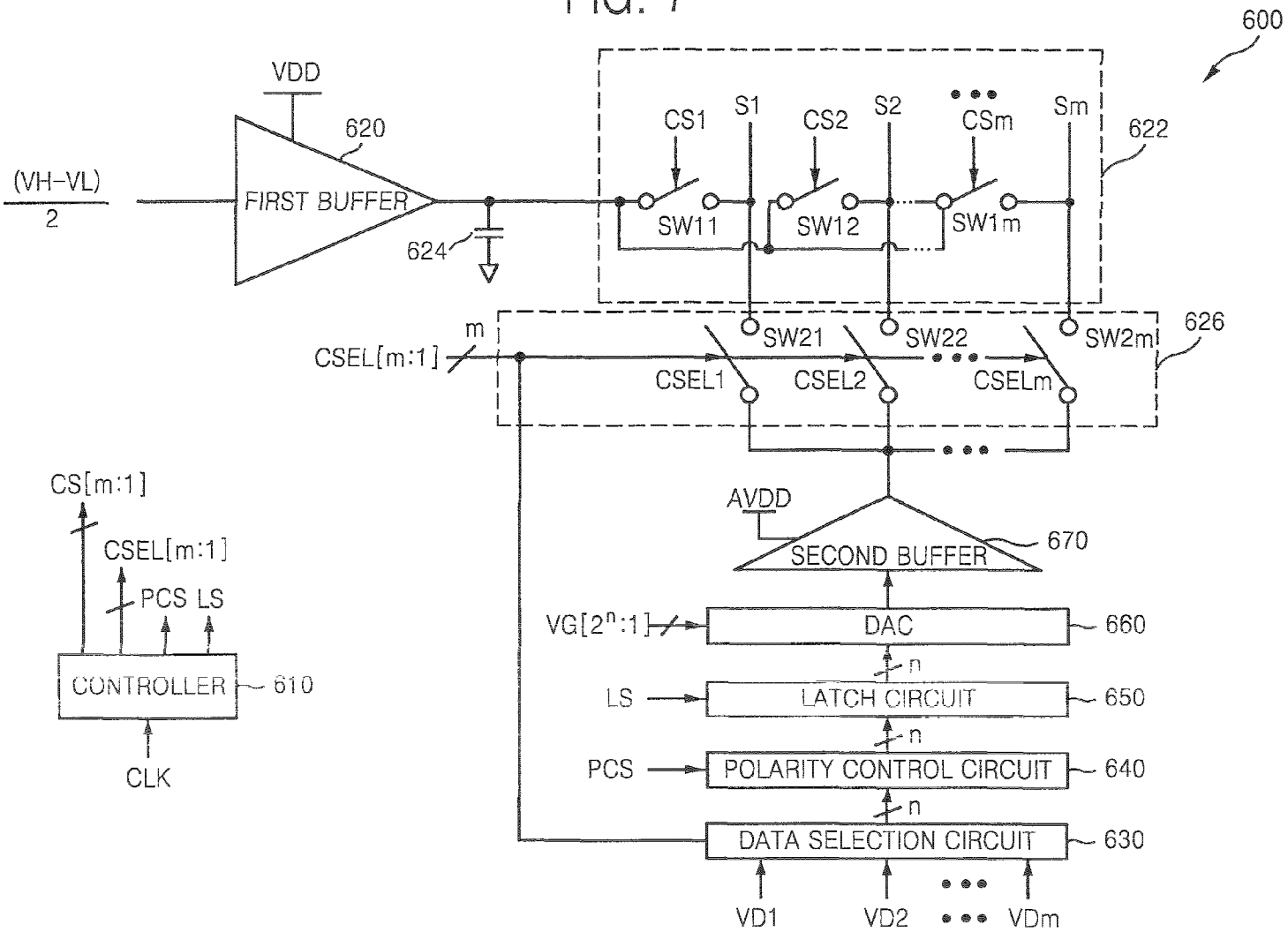
FIG. 7 is a structure diagram of a source driver according to some embodiments of the present invention.

FIG. 7 is a block diagram of a source driver 600 according to art exemplary embodiment of the present invention. Referring to FIG. 7, the source driver 600 includes a controller 610, a first buffer 620, a first switching block 622, a second switching block 626, a data selection circuit 630, a polarity control circuit 640, a latch circuit 650, a digital-to-analog circuit (DAC) 660, and a second buffer 670.

The controller 610 generates a plurality of control signals CS1 through CSm, a plurality of channel selection signals CSEL1 through CSELm, a polarity control signal PCS, and a latching signal LS in response to a clock signal CLK. The controller 610 may be installed outside the source driver 600 or inside the source driver 600.

The data selection circuit 630 receives a plurality of digital image data VD1 through VDm, selects one of them in response to the channel selection signals CSEL1 through CSELm, and outputs the selected digital image data. Each of the digital image data VD1 through VDm may include n bits (where n is a natural number).

The polarity control circuit 640 inverts or non-inverts output data of the data selection circuit 630 in response to the polarity control signal PCS and outputs the inverted or non-inverted data. The reason why the polarity control circuit 640 inverts the output data of the data selection circuit 630 is, as is generally known, for preventing degradation of the liquid crystal. The latch circuit 650 receives and stores output data of the polarity control circuit 640 and outputs the stored output data of the polarity control circuit 640 to the DAC 660 in response to the latching signal LS.

The DAC 660 receives a plurality of analog voltages VG[$2^n$:1] generated on the basis of the number of bits of digital image data, and outputs an analog voltage corresponding to output data of the latch circuit 650 from among the analog voltages VG[$2^n$:1]. For example, if the digital image data includes n bits, the number of analog voltages YG[$2^n$:1] is $2^n$, and the DAC 660 outputs the analog voltage corresponding to the output data of the latch circuit 650 from among the $2^n$ analog voltages VG[$2^n$:1].

The first buffer 620 receives a reference voltage VDD, and receives and buffers a predetermined voltage ((VH−VL)/2). The VH denotes the level of the highest voltage out of the $2^n$ analog voltages VG[$2^n$:1] that corresponds to the output data of the latch circuit 650 and is selected and output by the DAC 660. The VL denotes the level of the lowest voltage out of the $2^n$ analog voltages VG[$2^n$:1] that corresponds to the output data of the latch circuit 650 and is selected and output by the DAC 660.

Figure 9:
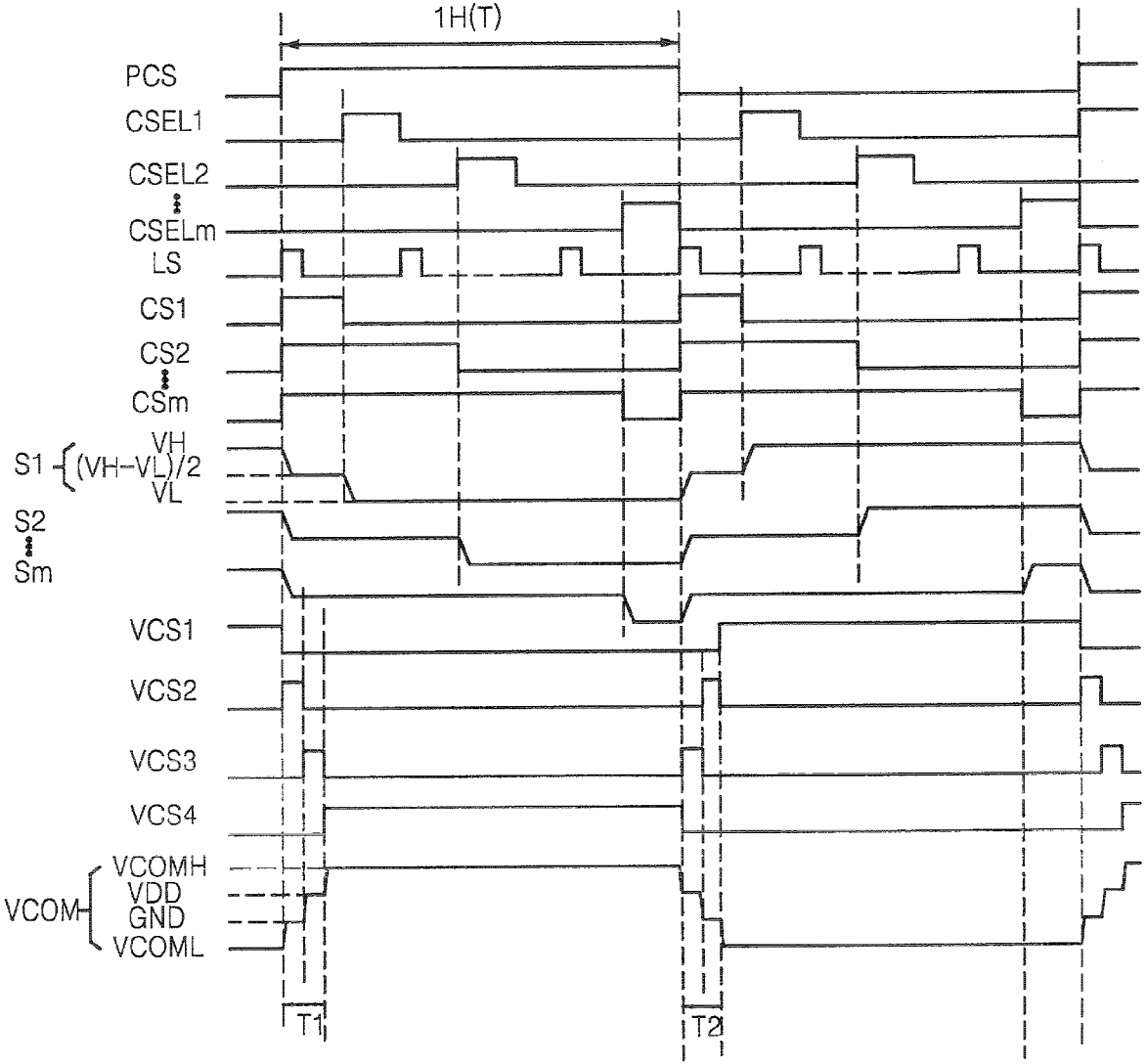
FIG. 9 is a timing diagram representing a driving operation of a display device according to an exemplary embodiment of the present invention.

The first switching block 622 includes a plurality of switches SW11 through SW1*m*, and supplies the predetermined voltage buffered by the first buffer 620 to at least one of a plurality of source lines S1 through Sm in response to the control signals CS1 through CSm. For example, as shown in FIG. 9, the switches SW11, through SW1*m* may be sequentially switched on in response to the control signals CS1, through CSm, respectively. In this case, the predetermined voltage buffered by the first buffer 620 may be sequentially supplied to the source lines S1 through Sm.

The source driver 600 may further include a capacitor 624 that is connected between an output terminal of the first buffer 620 and a ground line. The capacitor 624 keeps the output data of the first buffer 620 stable.

The second buffer 670 receives the first power supply voltage AVDD, and receives and buffers an analog voltage corresponding to digital image data. The second buffer 670 improves the current driving ability of the source driver 600. The second switching block 626 includes a plurality of switches SW21 through SW2*m*, and supplies an output voltage of the second buffer 670 to the one source line irons among the source lines S1 through Sm in response to the channel selection signals CSEL1 through CSELm.

In this exemplary embodiment, as shown in FIG. 9, the switches SW21 through SW2*m* may be sequentially switched on in response to the channel selection signals CSEL1 through CSELm. In this case, the analog voltage buffered by the second buffer 670 may be sequentially supplied to the source lines S1 through Sm.

The controller 610 may generate the control signals CS1 through CSm and the channel selection signals CSEL1 through CSELm so that an output voltage of the second buffer 670 is supplied to a first source line, for example, the source line S1, among the source lines S1 through Sm, after an output voltage of the first buffer 620 is supplied to the first source line.

Figure 8:
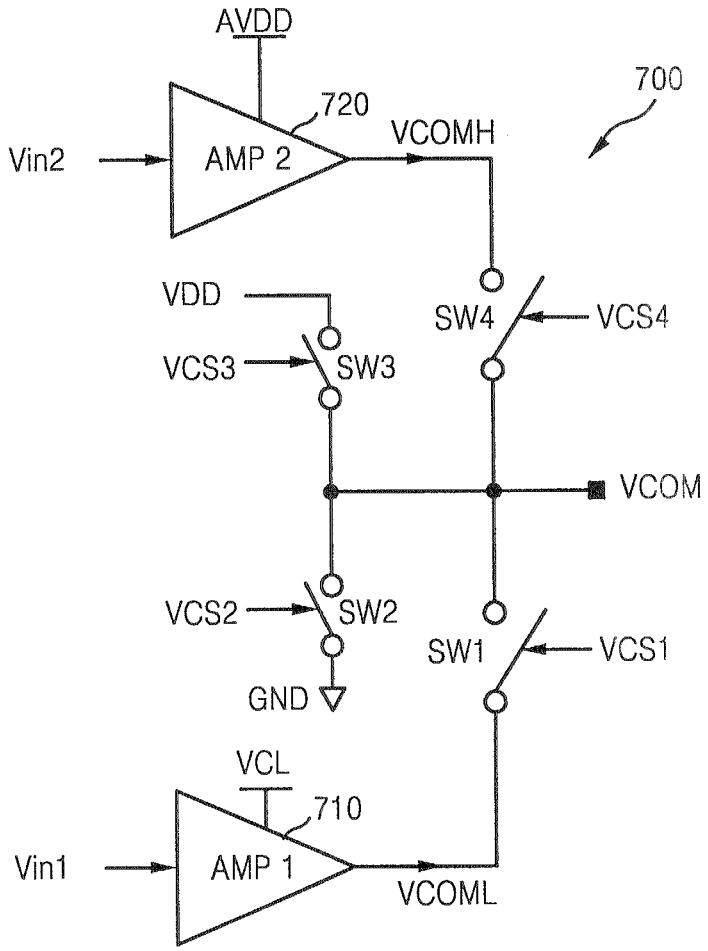
FIG. 8 is a structure diagram of a common voltage driver according to an exemplary embodiment of the present invention.

FIG. 8 is a block diagram of a common voltage driver 700 according to an exemplary embodiment of the present invention. Referring to FIG. 8, the common voltage driver 700 includes an output terminal VCOM, a first amplifier 710, a second amplifier 720, and first through fourth switches SW1 through SW4.

The first amplifier 710 receives a second power voltage VCL, and amplifies a first input voltage Vin1 to output a first voltage VCOML. The first switch SW1 is connected between an output terminal of the first amplifier 710 and the output terminal VCOM, and is switched on to supply the first voltage VCOML to the output terminal VCOM in response to a first voltage control signal VCS1.

The second switch SW2 is connected between a first line for receiving a second voltage GND and the output terminal VCOM, and is switched on to supply the second voltage GND to the output terminal VCOM in response to a second voltage control signal VCS2.

The third switch SW3 is connected between a second line for receiving a third voltage VDD and the output terminal VCOM, and is switched on to supply the third voltage VDD to the output terminal VCOM in response to a third voltage control signal VCS3.

The second amplifier 720 receives the first power voltage AVDD, and amplifies a second input voltage Vin2 to output a fourth voltage VCOMH. The fourth switch SW4 is connected between an output terminal of the second amplifier 720 and the output terminal VCOM, and is switched on to supply the fourth voltage VCOMH to the output terminal VCOM in response to a fourth voltage control signal VCS4.

It is assumed that a voltage level of the fourth voltage VCOMH is higher than that of the third voltage VDD, a voltage level of the third voltage VDD is higher than that of the second voltage GND, and a voltage level of the second voltage GND is higher than that of the first voltage VCOML.

The switches SW1 through SW4 may be switched on to discretely and sequentially increase a voltage level of the output terminal VCOM from the first voltage VCOML to the fourth voltage VCOMH, or to discretely and sequentially decrease a voltage level at the output terminal VCOM from the fourth voltage VCOMH to the first voltage VCOML, in response to the voltage control signals VCS1 through VCS4.

A process in which the voltage level of the output terminal VCOM is discretely and sequentially increased from the first voltage VCOML to the fourth voltage VCOMH is as follows. The switches SW1 through SW4 are sequentially switched on in response to the voltage control signals VCS1 through VCS4 that are sequentially activated, for example, have high levels, for example, in a sequence of SW1→SW2→SW3→SW4.

When the first voltage control signal VCS1 is activated, the first switch SW1 is switched on and thus the first voltage VCOML is supplied to the output terminal VCOM. When the second voltage control signal VCS2 is activated, the second switch SW2 is switched on and thus the second voltage GND is supplied to the output terminal VCOM. When the third voltage control signal VCS3 is activated, the third switch SW3 is switched on and thus the third voltage VDD is supplied to the output terminal VCOM. When the fourth voltage control signal VCS4 is activated, the fourth switch SW4 is switched on and thus the fourth voltage VCOMH is supplied to the output terminal VCOM.

Therefore, a voltage level of the output terminal VCOM discretely and sequentially increases from the first voltage to the fourth, voltage, for example, in a sequence of VCOML→GND→VDD→VCOMH.

On the other hand, a process in which the voltage level of the output terminal VCOM is discretely and sequentially decreased from the fourth voltage VCOMH to the first voltage VCOML is as follows. The switches SW1 through SW4 are switched on in response to the voltage control signals VCS1 through VCS4 that are activated in a sequence, for example, SW4→SW3→SW2→SW1, opposite to the sequence in the process in which the voltage level of the output terminal VCOM discretely and sequentially increases.

Therefore, the voltage level of the output terminal VCOM discretely and sequentially decreases from the fourth voltage to the first voltage in a sequence of VCOMH→VDD→GND→VCOML.

The controller 610 may generate the control signals CS1 through CSm, the channel selection signals CSEL1 through CSELm, and the voltage control signals VCS1 through VCS4 so that the output voltage of the second buffer 670 is supplied to at least one of the source lines S1 through Sm after the voltage level of the output terminal VCOM reaches the first voltage VCOML or the fourth voltage VCOMH.

FIG. 9 is a timing diagram representing a driving operation of a display device according to an exemplary embodiment of the present invention. Referring to FIGS. 7 through 9, the control signals CS1 through CSm having predetermined activation sections, for example, high levels, are applied to the switches SW11 through SW1*m* of the first switching block 622.

The switches SW11 through SW1*m* are switched on to supply the predetermined voltage buffered by the first buffer 620 to at least one of the source lines S1 through Sm, in response to the control signals CS1 through CSm.

In this exemplary embodiment, when a first control signal, for example, the control signal CS1, among the control signals CS1 through CSm is activated, the first switch SW11 is switched on and, thus, the predetermined voltage is supplied to the first source line S1 among the source lines S1 through Sm.

As shown in FIG. 9, the control signals CS1 through CSm keep an activated state until the corresponding channel selection signals CSEL1 through CSELm are activated. Therefore, voltages of the source lines S1 through Sm maintain the predetermined voltage until the corresponding channel selection signals are activated. The channel selection signals CSEL1 through CSELm may be activated at the points in time when the corresponding control signals CS1 through CSm are inactivated, for example, have low levels, respectively.

The data selection circuit 630 receives the digital image data VD1 through VDm, selects one out of them in response to the channel selection signals CSEL1 through CSELm, and outputs the selected digital image data. When a first channel selection signal, for example, CSEL1 is activated, the data selection circuit 630 may select and output digital image data VD1 corresponding to the first channel selection signal CSEL1.

Referring to FIG. 9, the channel selection signals CSEL1 through CSELm are activated sequentially, that is, in a sequence of CSEL1→CSEL2→ . . . →CSELm, and, thus, the data selection circuit 630 selects and outputs the digital image data VD1 through VDm sequentially, that is, in a sequence of VD1→VD2→ . . . →VDm. The polarity of the polarity control signal PCS is inverted every horizontal scan period 1H and this polarity control signal PCS is applied to the polarity control circuit 640. The polarity control circuit 640 inverts the polarity of the output data of the data selection circuit 630 every horizontal scan period 1H in response to the polarity control signal PCS.

The latching signal LS is a pulse signal that has as many activation sections, for example, high levels, as the number of image data VD1 through VDm for one horizontal scan period 1H. The latch circuit 650 outputs latched image data every time the latching signal LS is activated. Each of the switches SW21 through SW2*m* of the second switching block 626 is switched on to supply an output signal of the second buffer 670 to a corresponding source line among the source lines S1 through Sm in response to a corresponding channel selection signal among the channel selection signals CSEL1 through CSELm.

In this exemplary embodiment, when the first channel selection signals, for example, CSEL1, out of the channel selection signals CSEL1 through CSELm is activated, the first switch SW21 is switched on and, thus, the output signal of the second buffer 670 is supplied to the first source line S1 out of the source lines S1 through Sm.

As shown in FIG. 9, the channel selection signals CSEL1 through CSELm are activated sequentially, that is, in a sequence of CSEL1→CSEL2→ . . . →CSELm, and, thus, the switches SW21 through SW2*m* are switched on sequentially, that is, in a sequence of SW21→SW22→ . . . →SW2*m*, and the output signal of the second buffer 670 is sequentially supplied to the source lines, that is, in a sequence of S1→S2→ . . . →Sm.

Therefore, a voltage level of each of the source lines S1 through Sm reaches the predetermined voltage buffered by the first buffer 620 and then reaches a voltage level of the output signal buffered by the second buffer 670.

The voltage control signals VCS1 through VCS4 may be generated so that a voltage level of the output terminal VCOM of the common voltage driver 700 reaches the first voltage VCOML or the fourth voltage VCOMH before the first channel selection signal of the one horizontal scan period 1H is activated. First, a process (a section T1) in which the voltage level of the output terminal VCOM starts from the first voltage VCOML and reaches the fourth voltage VCOMH will be described below. Referring to FIGS. 8 and 9, the voltage control signals VCS1 through VCS4 are sequentially applied to the switches SW1 through SW4, respectively.

In an activation section of the first voltage control signal VCS1, the first switch SW1 is switched on and, thus, the voltage level of the output terminal VCOM becomes the first voltage VCOML. In an activation section of the second voltage control signal VCS2, the second switch SW2 is switched on and thus the voltage level of the output terminal VCOM becomes the second voltage GND. In an activation section of the third voltage control signal VCS3, the third switch SW3 is switched on and, thus, the voltage level of the output terminal VCOM becomes the third voltage VDD. In an activation section of the fourth voltage control signal VCS4, the fourth switch SW4 is switched on and, thus, the voltage level of the output terminal VCOM becomes the fourth voltage VCOMH.

Therefore, the voltage level of the output terminal VCOM starts from the first voltage and reaches the fourth voltage, that is, VCOML→GND→VDD→VCOMH. A process (a section T2) in which the voltage level of the output terminal VCOM starts from the fourth voltage VCOMH and reaches the first voltage VCOML is opposed to the process in which the voltage level of the output terminal VCOM starts from the first voltage VCOML and reaches the fourth voltage VCOMH. Therefore, the voltage level of the output terminal VCOM starts from the fourth voltage VCOML and reaches the first voltage VCOML.

Referring to FIG. 9, it is seen that after the voltage level of the output terminal VCOM reaches the first voltage VCOML or the fourth voltage VCOMH, the channel selection signals CSEL1 through CSELm are activated. An analog voltage corresponding to digital image data is provided to a corresponding source line among the source lines S1 through Sm after the voltage level of the output terminal VCOM is stabilized, so that a stable image can be realized.

Hereinafter, a maximum average current consumed for one horizontal scan period 1H in the source driver 600 and the common voltage driver 700 will be described with reference to FIGS. 5 through 9.

An average current Iavdd for the first power supply voltage AVDD of the second buffer 670 of the source driver 600 is calculated using Equation 5:

$$Iavdd = \frac{Cs((VH - VL)/2)}{2T} \tag{5}$$

An average current Ivcomh for the first power supply voltage AVDD of the second amplifier 720 of the common voltage driver 700 is calculated using Equation 6:

$$Ivcomh = \frac{Cs(VCOMH - VDD + (VH - VL)/2) + Ccom(VCOMH - VDD)}{2T} \tag{6}$$

An average current Ivcom1 for the second power supply voltage VCL of the first amplifier 710 of the common voltage driver 700 is calculated using Equation 7:

$$Ivcoml = \frac{Cs((VH - VL)/2 - VCOML) + Ccom(VCOML)}{2T} \tag{7}$$

A total average current Itot for the reference voltage VDD of the source driver 600 and the common voltage driver 700 is calculated using Equation 8, which is a sum of the average currents of Equations 5 to 7:

$$Itot = \frac{Cs(\alpha(VCOMH - VCOML + VH - VL) + \beta((VH - VL)/2 - VCOML) + VCOMH - (VH - VL)/2)}{2T} + \frac{Ccom(\alpha(VCOMH - VDD) - \beta(VCOML)) + 2VDD - VCOMH}{2T} \tag{8}$$

Compared to the average current consumed upon driving operations of the source driver 100 and the common voltage driver 200 using a general time division driving method, an average current Ireduce reduced upon driving operations of the source driver 600 and the common voltage driver 700 according to the exemplary embodiment of the present invention is calculated using Equation 9, which is obtained by subtracting Equation 8 from Equation 4:

$$Iredude = \frac{Cs(\alpha(VCOMH - VCOML + VH - VL) + (\beta - 1)(VCOMH - (VH - VL)/2))}{2T} + \frac{Ccom((\beta - 1)VCOMH - \alpha(VCOML) + (\alpha - 2)VDD)}{2T} \tag{9}$$

As shown in Equation 9, current consumption when the display device according to the exemplary embodiment of the present invention is driven using the source driver 600 and the common voltage driver 700 is reduced compared to that when a general display device is driven by the known method.

Figure 10:
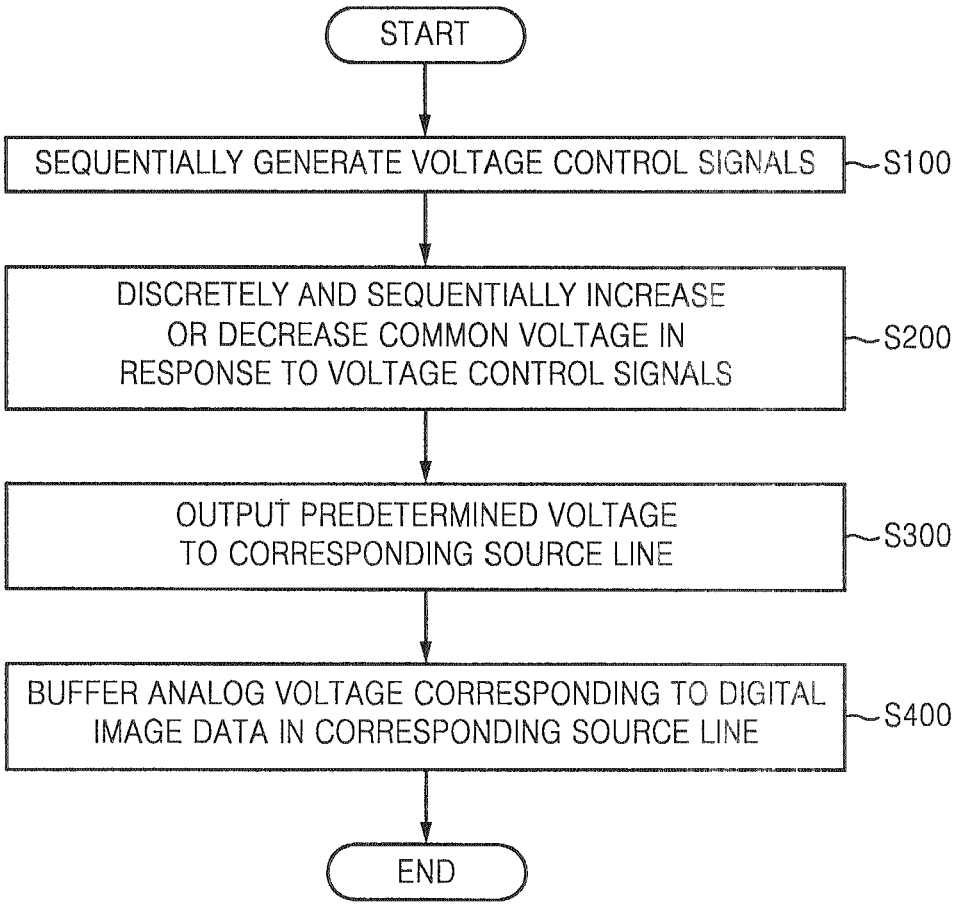
FIG. 10 is a flowchart illustrating a method of driving a display device, according to an exemplary embodiment of the present invention.

FIG. 10 is a flowchart illustrating a method of driving a display device, according to an exemplary embodiment of the present invention. Hereinafter, the method of driving the display device including the source driver 600 and the common voltage driver 700 will be described with reference to FIGS. 6 through 10.

First, a method of driving the common voltage driver 700 will be described. A controller (not shown) sequentially generates the voltage control, signals VCS1 through VCS4, each of them having predetermined activation sections, for example, high levels, in operation S100.

The switches SW1 through SW4 of the common voltage driver 700 discretely and sequentially increase or decrease the voltage level of the output terminal VCOM in response to the voltage control signals VCS1 through VCS4, in operation S200. A process in which the voltage level of the output terminal VCOM discretely and sequentially increases from the first voltage VCOML to the fourth voltage VCOMH is as follows. Referring to FIGS. 8 and 9, the voltage control signals VCS1 through VCS4 are sequentially applied to the switches SW1 through SW4, respectively.

In an activation section of the first voltage control signal VCS1, the first switch SW1 is switched on and, thus, the voltage level from the output terminal VCOM becomes the first voltage VCOML. In an activation section of the second voltage control signal VCS2, the second switch SW2 is switched on and, thus, the voltage level from the output terminal VCOM becomes the second voltage GND. In an activation section of the third voltage control signal VCS3, the third switch SW3 is switched on and thus the voltage level from the output terminal VCOM becomes the third voltage VDD. In an activation section of the fourth voltage control signal VCS4, the fourth switch SW4 is switched on and, thus, the voltage level from the output terminal VCOM becomes the fourth voltage VCOMH.

Therefore, the voltage level of the output terminal VCOM discretely and sequentially changes from the first voltage to the fourth voltage, that is, in sequence of VCOML→GND→VDD→VCOMH.

A process in which the voltage level of the output terminal VCOM discretely and sequentially decreases from the fourth voltage VCOMH to the first voltage VCOML, is opposite to the process in which the voltage level of the output terminal VCOM discretely and sequentially increases from the first voltage VCOML to the fourth voltage VCOMH.

Therefore, the voltage level of the output terminal VCOM discretely and sequentially changes from the fourth voltage VCOMH to the first voltage, that is, in a sequence, of VCOMH→VDD→GND→VCOML.

A method of driving the source driver 600 is as follows. A predetermined voltage ((VH—VL)/2) is buffered in a corresponding source line out of the plo source lines, in operation S300.

The control signals CS1 through CSm having predetermined activation sections, for example, high levels, are applied to the switches SW11 through SW1*m* of the first switching block 622.

The switches SW11 through SW1*m* are switched on to supply a predetermined voltage buffered in the first buffer 620 to a corresponding source line out of the source lines S1 through Sm in response to the control signals CS1 through CSm.

In this exemplary embodiment, when the first control signal, for example, CS1, out of the control signals CS1 through CSm is activated, the first switch SW11 is switched on and, thus, the predetermined voltage is supplied to the first source line S1 out of the source lines S1 through Sm.

As shown in FIG. 9, each of the control signals CS1 through CSm keeps an activated state until a corresponding channel selection signal out of the channel selection signals CSEL1 through CSELm is activated. Therefore, a voltage level of a corresponding source line out of the source lines S1 through Sm keeps the predetermined voltage until the corresponding channel selection signal is activated.

An analog voltage corresponding to digital image data is buffered in the corresponding source line out of the plurality of source lines S1 through Sm, in operation S400.

The switches SW21 through SW2*m* of the second switching block 626 are switched on to supply the output signal of the second buffer 670 to at least one of the source lines S1 through Sm in response to a corresponding channel selection signal out of the channel selection signals CSEL1 through CSELm. When the first channel selection signal, for example, CSEL1, out of the channel selection signals CSEL1 through CSELm is activated, the first switch SW21 is switched on and, thus, the output signal of the second buffer 670 is supplied to the first source line S1 out of the source lines S1 through Sm.

As shown in FIG. 9, because the channel selection signals CSEL1 through CSELm are sequentially activated, for example, in a sequence of CSEL1→CSEL2→ . . . →CSELm, the switches SW21 through SW2*m* are sequentially switched on, for example, in a sequence of SW21→SW22→ . . . →SW2*m*, and, thus, the output signal from the second buffer 670 is sequentially supplied to the source lines, for example, in a sequence of S1→S2→ . . . →Sm.

Therefore, each of the voltage levels of the source lines S1 through Sm reaches the predetermined voltage buffered by the first buffer 620 and then reaches the voltage level of the output signal of the second buffer 670.

The method of the exemplary embodiment for driving the source driver 600 may further include an operation of, the data selection circuit 630 selecting and outputting one corresponding image data out of the image data VD1 through VDm in response to the channel selection signals CSEL1 through CSELm, an operation of the polarity control circuit 640 controlling a polarity of the selected image data in response to the polarity control signal PCS, an operation of the latching circuit 650 latching the polarity-controlled image data in response to the latching signal LS, and an operation of the DAC 660 generating an analog voltage corresponding to the latched image data.

As mentioned above, a source driver that outputs an analog voltage corresponding to digital image data after precharging a corresponding one of a plurality of source lines with a predetermined voltage, and a common voltage driver discretely and sequentially increasing or decreasing a voltage level by using a common voltage driver are used upon driving of a display device according to an exemplary embodiment of the present invention. Therefore, power consumption is reduced compared to when a display device using a general source driver and a general common voltage driver is driven in the known manner.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A source driver comprising:

a first buffer buffering a predetermined voltage;

a plurality of first switches, each first switch having an input terminal connected to an output terminal of the first buffer and an output terminal connected to a corresponding respective one of a plurality of source lines;

a second buffer buffering an analog voltage corresponding to digital image data; and a plurality of second switches, each connected between an output terminal of the second buffer and a corresponding one of the plurality of source lines and responsive to a channel selection signal for selecting the corresponding one of the plurality of source lines, wherein the first switches are switched on in sequence in response to a respective control signal, and wherein each of the first switches remain switched on until the channel selection signal for selecting the corresponding one of the plurality of source lines is activated.

2. The source driver of claim 1, further comprising a capacitor connected between the output terminal of the first buffer and a ground line.

3. A source driver comprising:

a first buffer buffering a predetermined voltage;

a first switching block sequentially supplying an output voltage of the first buffer to a corresponding source line out of a plurality of source lines in response to a respective plurality of control signals;

a second buffer buffering an analog voltage corresponding to digital image data;

a second switching block supplying an output voltage of the second buffer to the corresponding source line out of the plurality of source lines in response to a respective plurality of channel selection signals; and a controller generating the plurality of control signals and the plurality of channel selection signals so that the output voltage of the second buffer is supplied to the corresponding source line out of the plurality of source lines after the output voltage of the first buffer is supplied to the corresponding source line out of the plurality of source lines, wherein the first switching block provides the output voltage of the first buffer in a sequence of voltage levels in multiple steps, wherein the first switching block comprises a plurality of first switches, each first switch having an input terminal connected to an output terminal of the first buffer and an output terminal connected to a corresponding respective one of a plurality of source lines, wherein the first switches are switched on in sequence in response to a respective control signal, and wherein each of the first switches remain switched on until the channel selection signal for selecting the corresponding one of the plurality of source lines is activated.

4. The source driver of claim 3 further comprising:

a data selection circuit selecting one of a plurality of image data in response to the plurality of channel selection signals and outputting the selected image data;

a polarity control circuit controlling a polarity of the output data of the data selection circuit in response to a polarity control signal;

a latch circuit latching the output data of the polarity control circuit in response to a latching signal; and a digital-to-analog converter generating the analog voltage corresponding to an output signal of the latch circuit.

5. A common voltage driver including an output terminal, the common voltage driver comprising:

a first amplifier amplifying a first input voltage to output a first voltage, the first voltage being a minimum common voltage;

a first switch connected between the output terminal of the common voltage driver and an output terminal of the first amplifier;

a second switch connected between a first line for receiving a second voltage and the output terminal of the common voltage driver;

a third switch connected between a second line for receiving a third voltage and the output terminal of the common voltage driver;

a second amplifier amplifying a second input voltage to output a fourth voltage, the fourth voltage being a maximum common voltage; and a fourth switch connected between the output terminal of the common voltage driver and an output terminal of the second amplifier, wherein the common voltage driver applies a common voltage to a display panel while a source driver applies image data to source lines of the display panel, wherein the first switch, the second switch, the third switch and the fourth switch are switched on in sequence:

to increase a voltage level of the output terminal of the common voltage driver from the first voltage to the fourth voltage in multiple steps, or to decrease the voltage level of the output terminal of the common voltage driver from the fourth voltage to the first voltage in multiple steps, and wherein the image data is applied to the source lines after the voltage level of the output terminal of the common voltage driver has increased in multiple steps to the maximum common voltage, or after the voltage level of the output terminal of the common voltage driver has decreased in multiple steps to the minimum common voltage.

6. A display device comprising:

a source driver including a first buffer buffering a predetermined voltage;

a first switching block sequentially supplying an output voltage of the first buffer to a corresponding source line out of a plurality of source lines in response to a respective plurality of control signals;

a second buffer buffering an analog voltage corresponding to digital image data;

a second switching block supplying an output voltage of the second buffer to the corresponding source line out of the plurality of source lines in response to a respective plurality of channel selection signals; and a controller generating the plurality of control signals and the plurality of channel selection signals so that the output voltage of the second buffer is supplied to the corresponding source line out of the plurality of source lines after the output voltage of the first buffer is supplied to the corresponding source line out of the plurality of source lines; and a display panel including the plurality of source lines, a plurality of gate lines, and a plurality of pixels, wherein the first switching block provides the output voltage of the first buffer in a sequence of voltage levels in multiple steps, wherein the first switching block comprises a plurality of first switches, each first switch having an input terminal connected to an output terminal of the first buffer and an output terminal connected to a corresponding respective one of a plurality of source lines, wherein the first switches are switched on in sequence in response to a respective control signal, and wherein each of the first switches remain switched on until the channel selection signal for selecting the corresponding one of the plurality of source lines is activated.

7. A display device comprising:

a source driver including a first buffer buffering a predetermined voltage;

a plurality of first switches, each first switch having an input terminal connected to an output terminal of the first buffer and an output terminal connected to a corresponding respective one of a plurality of source lines;

a second buffer buffering an analog voltage corresponding to digital image data; and a plurality of second switches, each connected between an output terminal of the second buffer and a corresponding one of the plurality of source lines and responsive to a channel selection signal for selecting the corresponding one of the plurality of source lines; and a display panel including the plurality of source lines, a plurality of gate lines, and a plurality of pixels, wherein the first switches are switched on in sequence in response to a respective control signal, and wherein each of the first switches remain switched on until the channel selection signal for selecting the corresponding one of the plurality of source lines is activated.

8. The display device of claim 7, further comprising a common voltage driver, the common voltage driver comprising:

an output terminal outputting a common voltage;

a first amplifier amplifying a first input voltage to output a first voltage;

a first switch connected between the output terminal and an output terminal of the first amplifier;

a second switch connected between a first line for receiving a second voltage and the output terminal of the common voltage driver;

a third switch connected between a second line for receiving a third voltage and the output terminal of the common voltage driver;

a second amplifier amplifying a second voltage to output a fourth voltage; and a fourth switch connected between the output terminal of the common voltage driver and an output terminal of the second amplifier.

9. The display device of claim 8, wherein the first switch, the second switch, the third switch and the fourth switch are switched on in sequence to increase a voltage level of the output terminal of the common voltage driver from the first voltage to the fourth voltage in multiple steps, or to decrease the voltage level of the output terminal of the common voltage driver from the fourth voltage to the first voltage in multiple steps.

10. A method of driving a display device, the method comprising:

buffering a predetermined voltage in a corresponding source line out of a plurality of source lines; and buffering an analog voltage corresponding to digital image data fed to the corresponding source line out of the plurality of source lines, wherein buffering the predetermined voltage comprises providing an output voltage from a first buffer though a first switching block to the corresponding source line in a sequence of voltage levels in multiple steps such that the output voltage of a second buffer that provides the analog voltage is supplied to the corresponding source line out of the plurality of source lines after the output voltage of the first buffer is sequentially supplied to the corresponding source line out of the plurality of source lines, wherein the first switching block comprises a plurality of first switches, each first switch having an input terminal connected to an output terminal of the first buffer and an output terminal connected to a corresponding respective one of a plurality of source lines, wherein the first switches are switched on in sequence in response to a respective control signal, and wherein each of the first switches remain switched on until the channel selection signal for selecting the corresponding one of the plurality of source lines is activated.

11. The method of claim 10, further comprising:

selecting one corresponding image data from among a plurality of image data in response to a plurality of channel selection signals and outputting the selected image data;

controlling a polarity of the selected image data in response to a polarity control signal;

latching the polarity-controlled image data in response to a latching signal; and generating an analog voltage corresponding to the latched image data.

* * * * *